United States Patent [19]

Stern

[11] Patent Number: 4,667,775

[45] Date of Patent: May 26, 1987

[54] HYDRAULIC ELEVATOR SYSTEM

[75] Inventor: Lawrence Stern, Morristown, N.J.

[73] Assignee: Westinghouse Electric Corp., Pittsburgh, Pa.

[21] Appl. No.: 857,676

[22] Filed: Apr. 30, 1986

[51] Int. Cl.[4] ..... B66B 11/04

[52] U.S. Cl. ..... 187/17; 187/95

[58] Field of Search ..... 187/17, 95, 8.41, 6; 92/165 R, 167, 168, 51-53, 117; 52/115

[56] References Cited

U.S. PATENT DOCUMENTS

| | | | |
|---|---|---|---|
| 2,689,025 | 9/1954 | Yates | 52/115 |
| 4,026,432 | 5/1977 | Abels | 187/95 X |
| 4,356,895 | 11/1982 | Kappenhagen et al. | 52/115 X |
| 4,361,209 | 11/1982 | Kappenhagen et al. | 187/17 |

FOREIGN PATENT DOCUMENTS

| | | | |
|---|---|---|---|
| 11030 | 6/1895 | United Kingdom | 187/17 |

*Primary Examiner*—Joseph J. Rolla

*Assistant Examiner*—Nils Pedersen

*Attorney, Agent, or Firm*—D. R. Lackey

[57] ABSTRACT

A hydraulic elevator system having a tunnel member as part of the car frame, to reduce the pit depth required for a hydraulic jack. A stabilizer for the plunger of the hydraulic jack is fixed to the bottom of the tunnel member, with the stabilizer being in an inactive, retracted position while the cylinder head is within the tunnel member. The stabilizer is automatically actuated to an operative plunger support position, as the elevator car rises and the bottom of the tunnel member starts to rise higher than the cylinder head, to provide an additional lateral support point for the plunger. The lateral support function provided by the stabilizer functions at all times, in both the active and inactive positions, without any wear inducing relative motion between the stabilizing surfaces of the stabilizer, and any other element of the system, including the hydraulic jack, its plunger, or the tunnel of the car frame.

5 Claims, 6 Drawing Figures

HYDRAULIC ELEVATOR SYSTEM

BACKGROUND OF THE INVENTION

1. Field of the Invention

The invention relates in general to hydraulic elevator systems, and more specifically to holeless, or semi-holeless hydraulic elevator systems.

2. Description of the Prior Art

In a hydraulic elevator system, the allowable length of the plunger nearly doubles with the use of a plunger-follower guide. Thus, a much smaller jack may be used, as calculated according to the ANSI-ASME A17.1-1981 safety code for elevators and escalators. The use of a smaller jack is especially desirable in the hydraulic elevator system disclosed in U.S. Pat. No. 4,361,209, which is assigned to the same assignee as the present application. The hydraulic elevator system disclosed in that patent utilizes a tunnel member which is part of the car frame, and which extends vertically upward through the elevator car to eliminate the need for, or to minimize the depth of, a hole for the hydraulic jack. Reducing the size of the hydraulic jack in this application reduces the cross-sectional area of the tunnel, which in turn reduces the horizontal dimension of the swing return which faces the front of the elevator car. Reducing this dimension reduces the size of the hatch, for a given useful floor space in the elevator car.

The hereinbefore-mentioned U.S. Pat. discloses the use of a stabilizer assembly within the tunnel, which is always fixed to a selected portion of the hydraulic jack, i.e., to the section of the hydraulic jack which is immediately below the uppermost plunger section. The stabilizer assembly includes four rollers which are biased against the four inner corners of a square-configured tunnel. This was an improvement over prior art stabilizing means which utilizes complicated support arms, clamps, and the like, which must be synchronized with car movement.

While the stabilizer-roller assembly of U.S. Pat. No. 4,361,209 functions well, its use is effectively limited to telescopic jacks. On a single stage jack the bottom of the tunnel would not be able to move higher than the cylinder head, as the stabilizer assembly is fixed to the cylinder head. Thus, it would be desirable to provide new and improved stabilizer means for a single-stage jack-/tunnel structure which provides the requisite plunger support, without the limitation of maintaining the cylinder head within the tunnel.

In my co-pending application Ser. No. 663,527, filed Oct. 22, 1984, entitled "Hydraulic Elevator System", a stabilizer member in the tunnel is releasably latched to the cylinder head of a single stage hydraulic jack, while the cylinder head is within the tunnel. As the tunnel leaves the cylinder head during the ascension of the elevator car, the stabilizer member is automatically released from the cylinder head. The stabilizer member, which requires no moving parts, then moves the plunger and tunnel, providing a lateral support point for the plunger, at the most advantageous position. The stabilizer member increases its support as the elevator car continues to rise, with this additional support point functioning without any relative motion between the stabilizer member, plunger or tunnel. The support provided by the stabilizer member extends from the plunger, through the stabilizer member to the tunnel, which in turn is part of the car frame or sling. The frame is firmly supported against lateral movement by the guide rollers which rotate against guide rails fixed in the hatch of the associated building.

SUMMARY OF THE INVENTION

The present invention is a new and improved hydraulic elevator system having a car frame which includes a tunnel structure disposed upwardly through the elevator car. Stabilizer means is disposed in the tunnel which obtains all of the advantages of the stabilizer arrangement of my co-pending application, without having any relative motion between the stabilizer, tunnel and hydraulic jack which could cause wear. In my hereinbefore-mentioned co-pending application, there is relative motion between the stabilizer element and the tunnel, and between the stabilizer element and the plunger, until the tunnel leaves the cylinder head during ascension of the elevator car. The stabilizer is then released from the cylinder head of the hydraulic jack to move with the tunnel and plunger without relative motion therebetween.

In the present invention, instead of latching the stabilizer means to the cylinder head, the stabilizer means is fixed to the lower end of the tunnel. When the cylinder head is within the tunnel, the stabilizer means is in an inactive or retracted position such that there is no relative motion between the plunger support surfaces of the stabilizer means and the tunnel or jack. When the tunnel rises above the cylinder head, the stabilizer means is automatically actuated to an active plunger support configuration which causes its support surfaces to closely surround and move with the plunger without any relative motion between the stabilizer means, plunger, or tunnel.

BRIEF DESCRIPTION OF THE DRAWINGS

The invention may be better understood, and further advantages and uses thereof more readily apparent, when considered in view of the following detailed description of exemplary embodiments, taken with the accompanying drawings, in which.

DESCRIPTION OF THE PREFERRED EMBODIMENTS

In order to reduce the length and complexity of the description, the invention will be described as being applied to the front tunnel arrangement of the hereinbefore-mentioned U.S. Pat. No. 4,361,209, and this patent is hereby incorporated into the specification of the present application by reference. It is to be understood, however, that while this use of the stabilizer arrangement is the preferred embodiment, that the invention may be used with any holeless, or semi-holeless hydraulic elevator system having at least one hydraulic jack which extends into a tunnel arrangement.

Figure 3:
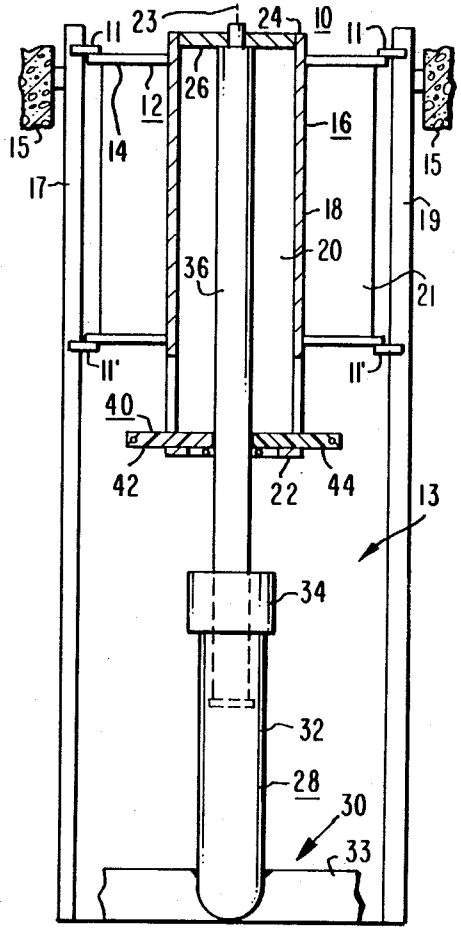
FIG. 3 is a view similar to that of FIGS. 1 and 2, except with the plunger more fully extended, to illustrate how the support function provided by the stabilizer assembly moves with the tunnel structure and plunger.
Figure 2:
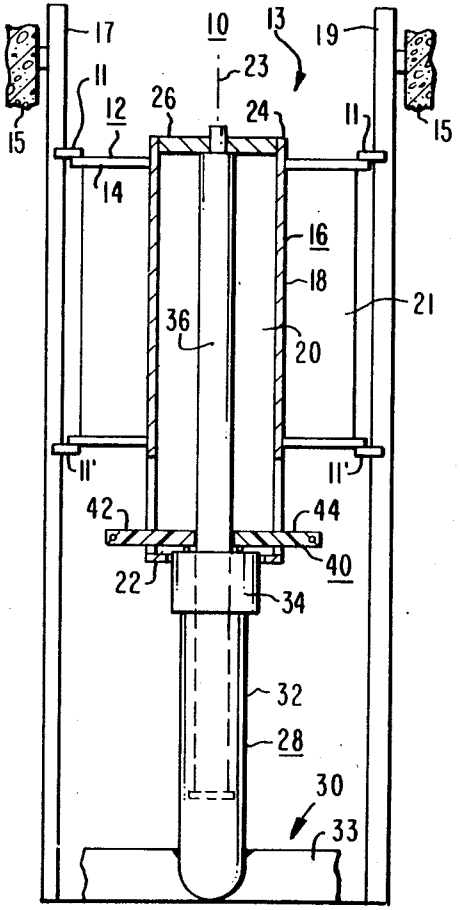
FIG. 2 is a view similar to that of FIG. 1, except with the plunger extended to a point where the cylinder head is just visible below the lower end of the tunnel, and with the stabilizer assembly now being shown in its operative position.
Figure 1:
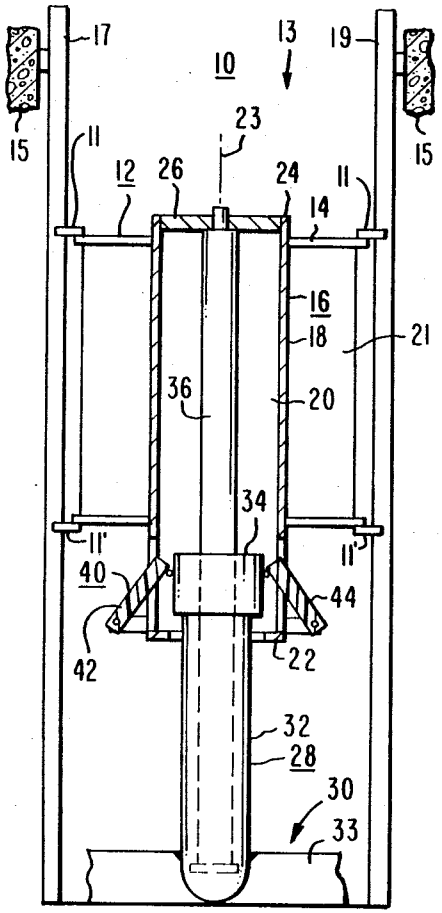
FIG. 1 is an elevational view, partially in section, of a hydraulic elevator system constructed according to the teachings of the invention, with the plunger being shown retracted to a point where the cylinder head is within a tunnel structure, and with a stabilizer assembly in its inoperative position.

Referring now to the drawings, and to FIGS. 1, 2 and 3 in particular, there is shown a hydraulic elevator system 10, in side elevation, constructed according to the teachings of the invention. Elevator system 10 includes an elevator car 12 mounted for guided vertical movement in a hatch 13 of an associated building 15, via upper and lower guide roller assemblies 11 and 11', respectively, and first and second spaced guide rail members 17 and 19, respectively. Elevator car 12 includes a cab 21 supported by a car frame or sling 14. An elongated, vertically oriented, tunnel structure 16 forms a structural element of the car frame 14, extending between the top and bottom horizontal beams of the car frame 14. Tunnel structure or member 16 includes a metallic side wall portion 18 of any desired cross-sectional configuration, with the side wall portion 18 defining an opening 20 having a longitudinal axis 23 which extends between an open lower end 22 and an upper end 24. Upper end 24 is at least partially closed by an end plate or member 26.

A single stable hydraulic jack 28 is mounted in a hatch pit 30 at the bottom of hatch 13, with its longitudinal axis coaxial with the axis 23 of the tunnel member 16. Hydraulic jack 28 provides the motive means for the elevator car 12. Hydraulic jack 28 includes a cylinder 32, which is fixed to suitable horizontal cross members or beams 33, a cylinder head 34, and a plunger 36. U.S. Pat. No. 4,041,845, which is assigned to the same assignee as the present application, discloses a cylinder head construction which may be used. The end of plunger 36 contacts the end plate 26. End plate 26 may have a small opening therein for receiving a portion of the top of plunger 36, to clearly indicate that the plunger is properly centered on the end plate.

A stabilizer assembly 40, constructed according to the teachings of the invention, is carried by tunnel member 16 near its open lower end 22. Stabilizer assembly 40 includes at least first and second elongated plunger support members 42 and 44, respectively. Support members 42 and 44 have an inactive, non-support position when the cylinder head 34 is located within tunnel 16, as shown in FIG. 1, and an active, operative plunger support position shown in FIGS. 2 and 3 which automatically becomes effective as the cylinder head 34 becomes visible as the car 12 ascends, as shown in FIG. 2. At the car 12 continues to rise, the support members 42 and 44 move with the tunnel 16 and plunger 36, always retaining a fixed predetermined dimension from the upper end of the plunger 36 to the support position. As shown in FIGS. 1, 2 and 3, the plunger support members 42 and 44 may be pivotally fixed to tunnel 16.

Stabilizer means 40 starts to provide lateral support for plunger 36 the instant the stabilizer means 40 pivots to the operative position shown in FIGS. 2 and 3. The support proceeds from the plunger through the support members 42 and 44 to the tunnel 16, to the car frame 14, and then via the guide roller assemblies 11' to the guide rail members 17 and 19. The greater the extension of plunger 36, the greater the support. It is important to note that no binding can occur while stabilizer means 40 is providing its lateral support function, since there is never any relative motion between the stabilizer means 40, plunger 36, and tunnel 16. It is also important to note that the plunger support surfaces pivot out of support relationship with the plunger as shown in FIG. 1, when plunger support is not required.

Figure 4:
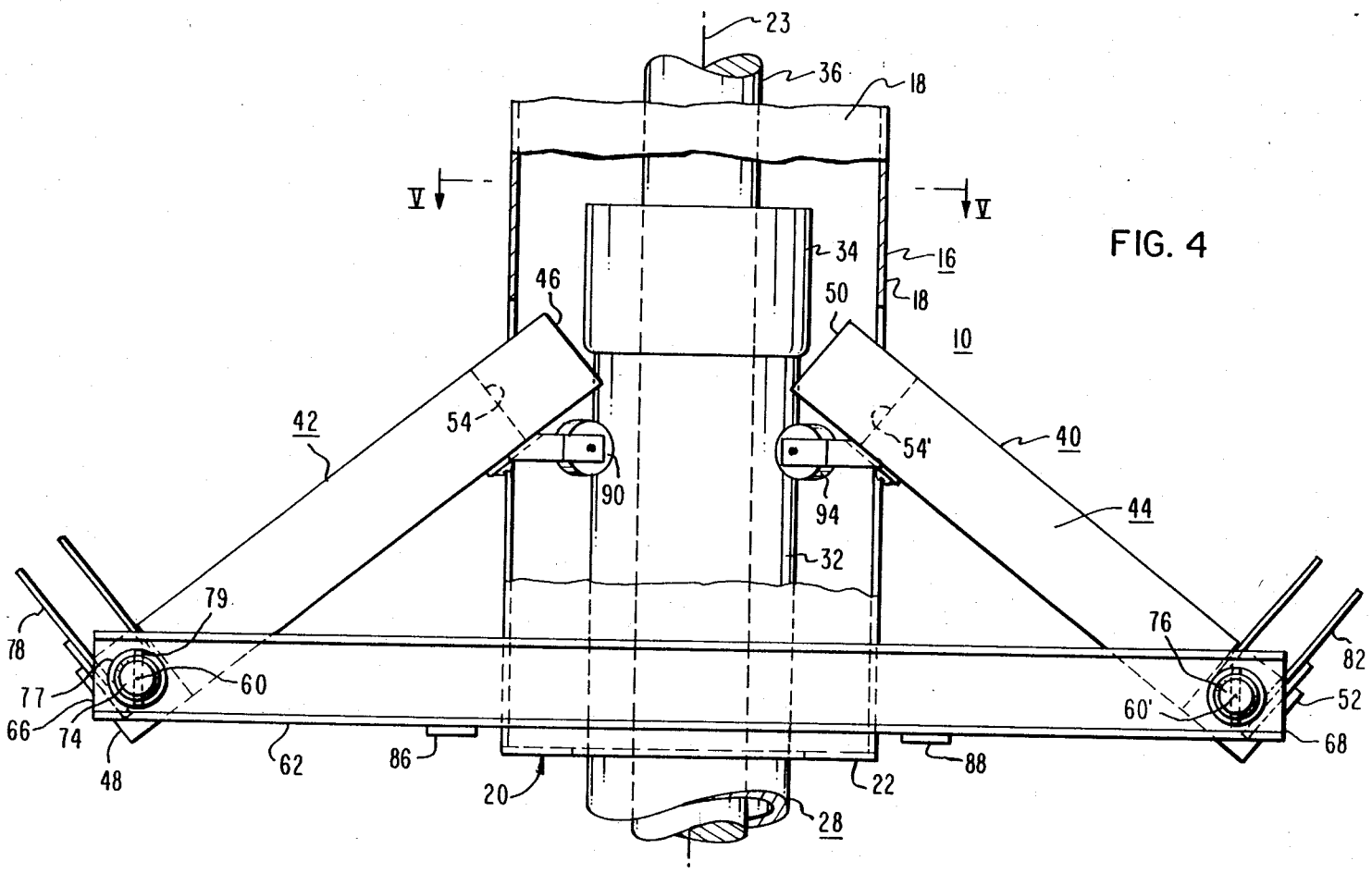
FIG. 4 is an enlarged elevational view, partially in section, of the stabilizer assembly shown in the inactive or inoperative position of FIG. 1 illustrating an exemplary construction and mounting arrangement for the stabilizer assembly, which includes pivot support means carried by the tunnel structure.
Figure 5:
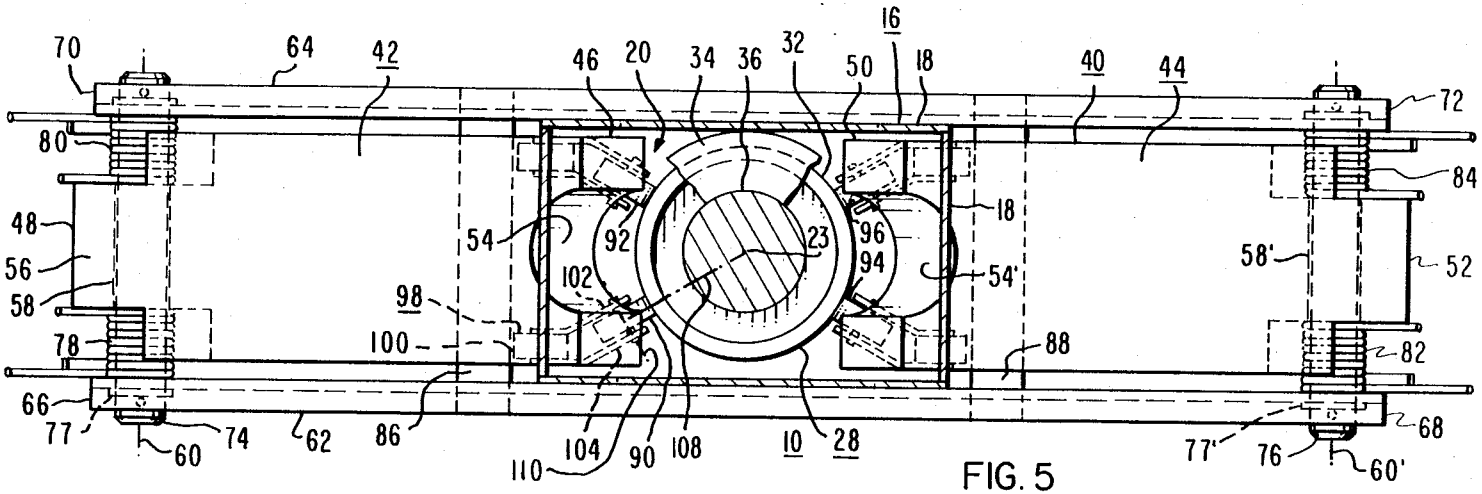
FIG. 5 is a cross-sectional view of the stabilzer assembly shown in FIG. 4, taken between and in the direction of arrows V—V.
Figure 6:
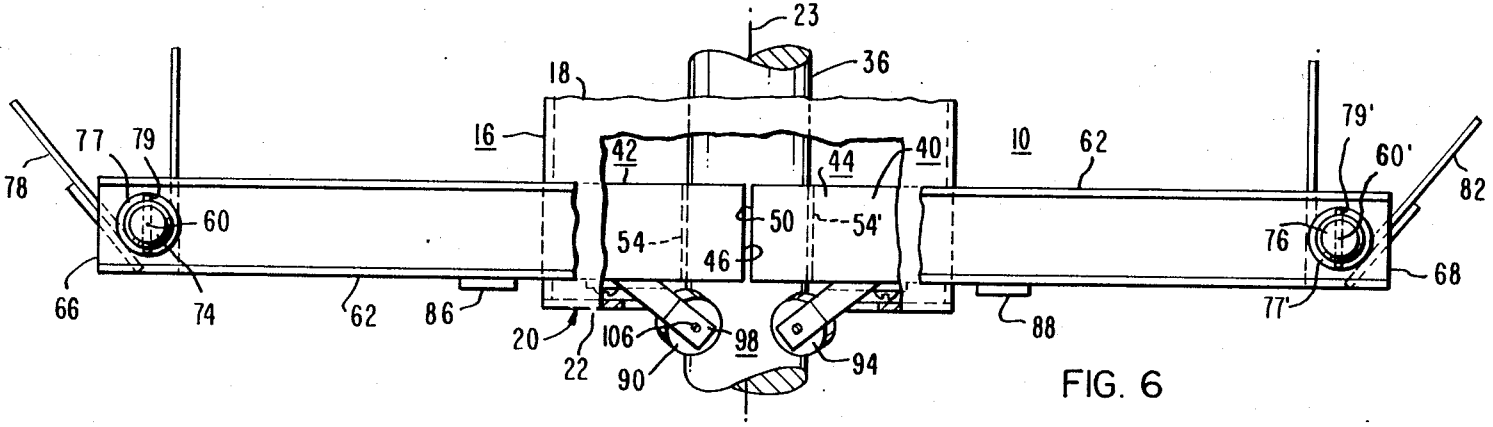
FIG. 6 is a view of the stabilizer assembly similar to that shown in FIG. 4, except with the stabilizer assembly being shown in its operative plunger support position.

FIGS. 4, 5 and 6 will now be referred to in order to describe in detail an exemplary embodiment of the invention. FIG. 4 is an elevational view of stabilizer assembly 40 in the inoperative or inactive non-support position shown in FIG. 1. FIG. 5 is a cross-sectional view taken through plunger 36 just above the stabilizer assembly 40, with the section being taken between and in the direction of arrows V—V in FIG. 4. FIG. 6 is an elevational view, similar to that of FIG. 4, except illustrating the stabilizer assembly in the active or operative plunger support position of FIGS. 2 and 3.

More specifically, each of the elongated support members 42 and 44 have first and second ends, such as the first and second ends 46 and 48, respectively, of the first support member 42, and first and second ends 50 and 52, respectively, of the second support member 44. Additional support members may be used, if desired, such as to provide a 3-point support assembly of a 4-point support assembly. The description of the 2-point support system of the exemplary embodiment will make it clear how additional plunger support points may be added about the plunger, if desired.

Since each of the at least first and second support members 42 and 44 and the associated mounting structure, are of like construction, only support member 42 and its mounting structure will be described in detail. Like reference numerals except with the prime mark will identify elements of support member 44 which are the same as support member 42.

More specifically, support member 44 is essentially in the form of a flat bar of suitable material having a substantially rectangular cross-sectional configuration. The width of support member 42, in this 2-support point embodiment, is preferably greater than the diameter of plunger 36, and its thickness is selected for mechanical strength. The material of which support member 42 is constructed is preferably non-metallic, in order to prevent damage to plunger 36 when support member 42 is called upon to provide lateral support. For example, a plastic material having the requisite dimensionsl stability and strength may be used. An ultra-high molecular weight polyethylene is excellent for the application, but other plastic materials may be used. The first end 46 of support member 42 includes a curved plunger support surface 54. The curve of surface 54 is a portion of a circular cylinder having a radius only slightly larger than the radius of plunger 36. The second end 49 of support member 42 is notched at each corner to remove a portion of the corner for the purpose of providing space for bias means, as will be hereinafter explained. The notched corners define a central extension 56 at end 48, with an opening 58 extending between the surfaces of extension 56 created by notching the corners at end 48. Opening 58 has a horizontally extending longitudinal axis 60.

Mounting structures for pivotally mounting support members 42 and 44 to tunnel 16 include first and second elongated channel members 62 and 64, respectively. Channel members 62 and 64 are fixed to two opposite sides of tunnel 16, such as by welding. Channel member 62 has first and second ends 66 and 68, respectively, and channel member 64 has first and second ends 70 and 72, respectively. Channel members 62 and 64 have a like length dimension selected such that their first ends 66 and 70 extend outwardly from a first side of tunnel 16 by a predetermined dimension, and such that second ends 68 and 72 extend outwardly from tunnel 16 by the same predetermined dimension, but on a second side which is opposite to the first side of tunnel 16. The first ends 66 and 70 each have an opening for receiving a pivot pin 74, and the second ends 68 and 72 each have an opening for receiving a pivot pin 76.

Pivot pin 74 extends through opening 58 in support member 42 to pivotally mount support member 42 on pivot axis 60, and pivot pin 76 extends through opening 58′ in support member 44 to pivotally mount support member 44 on pivot axis 60′. A washer and a roll pin disposed through an opening in the pivot pin may secure each end of each pivot pin in the proper position. For example, a washer 77 and roll pin 79 may be used to secure an end of pivot pin 74, as shown in FIGS. 4 and 6.

Bias means, such as first and second torsion springs 78 and 80, are disposed to bias support member 42 towards its operative position, and in like manner, bias means, such as first and second torsion springs 82 and 84, are disposed to bias support members 44 towards its operative support position. Suitable stop means, such as provided by members 86 and 88 may be used to limit the biased movement of support members 42 and 44, respectively, once they reach their operative support positions.

In order to protect ends 46 and 50 of support members 42 and 44, respectively, from damage as these support members 42 and 44 are operated between their inactive and active positions, first and second rollers 90 and 92 are mounted on the bottom surface of support member 42 adjacent to the first end 46 of support member 42. In like manner, first and second rollers 94 and 96 are mounted on the bottom surface of support member 44, adjacent to the first end 50 of support member 44. Suitable mounting means having a flat back portion and depending leg portions may be used to mount each roller in the proper position. For example, mounting means 98 for mounting roller 90 may be used, which has a flat back portion 100 secured to stabilizer member 46, and depending spaced leg portions 102 and 104. Leg portions 102 and 104 rotatably secure roller 90 in the proper position via a axle 106. Screws, for example, may be used to secure the flat back portion 100 of the mounting means 98 to the support member 42.

Rollers 90, 92, 94 and 96 each have their rotational axes oriented perpendicular to a line drawn from the center of each roller to the axis 23 of plunger 36. This is illustrated by broken line 108 in FIG. 5 which extends from the horizontal rotational axis 110 of roller 90 to the vertical axis 23 of plunger 36. Rollers 90, 92, 94 and 96 are positioned such that when they contact cylinder 32, or cylinder head 34, they roll smoothly while preventing the ends 46 and 50 of support members 42 and 44 from making contact with the hydraulic jack 28.

In the operation of stabilizer means 40, it will be assumed that the plunger 36 is extended such that the stabilizer means 40 is in the operative plunger supporting position shown in FIGS. 2, 3 and 6. In this position, support members 42 and 44 have their support surfaces 54 and 54′ closely adjacent to plunger 36, with just enough clearance to allow members 42 and 44 to pivot from, or to, their inactive positions. Plunger 36 can thus extend with stabilizer means 40 providing increasing lateral support which is directly proportional to plunger extension. As the plunger 36 is retracted to lower elevator car 12, rollers 90, 92, 94 and 96 will eventually make contact with cylinder head 34 as the tunnel 16 starts to lower around the cylinder head. This action will automatically pivot support members 42 and 44 against the bias of their associated torsion springs, causing the support members 42 and 44 to pivot towards their inactive positions. The rollers then smoothly roll along the side of cylinder head 34, and along the side of cylinder 32, as the elevator car 12 continues to descend. During this downward movement, there is no wear producing relative movement past the support surfaces 54 and 54′ of the support members 42 and 44, respectively.

When the elevator car 12 makes an upward run from this lowered position, the bias provided by the torsion springs 78, 80, 82 and 84 will pivot support members 42 and 44 from their inactive, non-plunger supporting positions shown in FIGS. 1, 4 and 5 to their active plunger supporting positions shown in FIGS. 2, 3 and 6. In the non-support position, rollers 90, 92, 94 and 96 are operational and the plunger supporting surfaces 54 and 54′ of the support members 42 and 44 are not operational. In the plunger supporting position of the stabilizer assembly 40, rollers 90, 92, 94 and 96 are inactive, and the plunger support surfaces 54 and 54′ are effective.

In summary, the disclosed plunger stabilizer assembly positions plunger support at the most advantageous position, without following along the plunger, allowing the free length of the plunger to nearly double while saving space compared with the conventional folower type guide. Complete absence of relative motion past the plunger support surfaces in both the active and inactive positions of the stabilizer assembly assures long support life and trouble-free operation.

I claim as my invention:

1. A hydralic elevator system, comprising:

a car frame which includes an elongated tunnel member having a side wall which defines a open lower end and an at least partially closed upper end, a hydraulic jack having a cylinder, a cylinder head and a plunger, said hydraulic jack extending into said tunnel member to reduce the distance below the car frame required to accommodate the hydraulic jack, and plunger stabilizer means carried by said tunnel member near its open lower end, said stabilizer means having an inactive, nonsupport position when the cylinder head is within said tunnel member, and an operative plunger support position when the cylinder head is outside said tunnel member, said stabilizer means being automatically operated between its non-support and support positions by movement of the tunnel member and stabilizer means relative to said cylinder head, said stabilizer means including plunger support surfaces which move with the plunger in the plunger support position, and which move away from the plunger in the non-support position.

2. The hydraulic elevator system of claim 1 wherein the stabilizer means includes a least first and second elongated support members each having first and second ends, with a plunger support surface at the first end and a pivot axis near the second end, and means for pivotally mounting said at least first and second support members on the tunnel member for predetermined pivotal movement about their pivot axes.

3. The hydraulic elevator system of claim 2 including a roller carried by each of the at least first and second support members near the first end of the associated support member, with said roller contacting either the cylinder head or the cylinder in the inactive non-support position of the stabilizer means, and with said roller being inactive in the operative plunger support position of the stabilizer means.

4. The hydraulic elevator system of claim 2 including bias means disposed to urge each of the at least first and second support members towards the operative, plunger-support position of the stabilizer means.

5. The hydraulic elevator system of claim 2 wherein the means for pivotally mounting the at least first and second support members includes first and second elongated channel members each having first and second ends, said first and second elongated channel members being fixed in spaced relation to the tunnel member such that their first and second ends extend outwardly from the tunnel member in opposite directions, and including first and second pivot pins fixed to the first and second ends, respectively, of the first and second elongated channel members, for pivotally mounting the at least first and second support members.

* * * * *